US010045631B2

(12) United States Patent
Tiffany

(10) Patent No.: US 10,045,631 B2
(45) Date of Patent: Aug. 14, 2018

(54) CONVERTIBLE FURNITURE WITH SELECTIVELY EXPANDABLE MATTRESS CUSHION SECTION(S)

(71) Applicant: Tiffany & Tiffany Designers, Inc., Point Pleasant, PA (US)

(72) Inventor: H. Robert Tiffany, Point Pleasant, PA (US)

(73) Assignee: TIFFANY & TIFFANY DESIGNERS, INC., Point Pleasant, PA (US)

( * ) Notice: Subject to any disclaimer, the term of this patent is extended or adjusted under 35 U.S.C. 154(b) by 0 days.

(21) Appl. No.: 14/790,117

(22) Filed: Jul. 2, 2015

(65) Prior Publication Data

US 2015/0305513 A1 Oct. 29, 2015

Related U.S. Application Data

(63) Continuation of application No. 13/771,232, filed on Feb. 20, 2013, now Pat. No. 9,095,221.

(51) Int. Cl.

| | |
|---|---|
| ***A47C 27/00*** | (2006.01) |
| ***A47C 17/04*** | (2006.01) |
| ***A47C 17/13*** | (2006.01) |
| ***A47C 17/17*** | (2006.01) |
| ***A47C 17/207*** | (2006.01) |
| ***A47C 7/14*** | (2006.01) |
| ***A47C 7/50*** | (2006.01) |
| ***A47C 27/14*** | (2006.01) |

(52) U.S. Cl.

CPC ..... *A47C 27/00* (2013.01); *A47C 7/14* (2013.01); *A47C 7/506* (2013.01); *A47C 17/04* (2013.01); *A47C 17/13* (2013.01); *A47C 17/132* (2013.01); *A47C 17/136* (2013.01); *A47C 17/17* (2013.01); *A47C 17/2076* (2013.01); *A47C 27/144* (2013.01); *A47C 17/2073* (2013.01)

(58) Field of Classification Search

CPC ..... A47C 17/04
USPC ..... 5/722, 730, 740, 657, 12.1
See application file for complete search history.

(56) References Cited

U.S. PATENT DOCUMENTS

| | | | | |
|---|---|---|---|---|
| 1,691,992 A | | 11/1928 | Putty | |
| 1,721,647 A | | 7/1929 | Stoltenberg | |
| 2,830,306 A | * | 4/1958 | Wagner | A47C 27/144 5/722 |
| 3,041,635 A | | 7/1962 | Holtzclaw | |
| 3,239,851 A | | 3/1966 | Barabas | |

(Continued)

*Primary Examiner* — Fredrick C Conley
(74) *Attorney, Agent, or Firm* — Drinker Biddle & Reath LLP

(57) ABSTRACT

A cushion, mattress or mattress section for a convertible furniture article defines a plurality of apertures, such as slits or slots or recesses, extending into or through the cushion or mattress section that are cut in a direction at an angle to the first length of the mattress section. The cushion or mattress section expands from its first length to a second length that is longer than the first length upon applying a stretching force to the cushion or mattress section and thereby positioning the mattress section into the open or sleeping configuration. Expansion is due to resilience of the material forming the mattress or mattress section in combination with opening of the apertures. The sleeping surface of the mattress or mattress section may remain substantially planar in both the open (sleeping) position and closed (seating) position.

25 Claims, 15 Drawing Sheets

(56) References Cited

U.S. PATENT DOCUMENTS

| | | | |
|---|---|---|---|
| 3,258,787 | A | 7/1966 | Emmons |
| 3,798,683 | A | 3/1974 | Alembik |
| 4,067,073 | A | 1/1978 | Komarov |
| 4,086,671 | A | 5/1978 | Lane |
| 4,176,414 | A | 12/1979 | Wright et al. |
| 4,205,405 | A | 6/1980 | Hagney |
| 4,294,240 | A | 10/1981 | Thill |
| 4,301,559 | A | 11/1981 | Geenberghe |
| 4,378,609 | A | 4/1983 | Patterson et al. |
| 4,586,206 | A | 5/1986 | Singer |
| 4,628,551 | A | 12/1986 | Atimichuk |
| 4,737,996 | A | 4/1988 | Tiffany |
| 4,803,742 | A | 2/1989 | Rasnick et al. |
| 4,860,393 | A | 8/1989 | Schefthaler |
| 4,928,337 | A | 5/1990 | Chauncey |
| 5,101,524 | A | 4/1992 | Brandschain |
| 5,231,710 | A | 8/1993 | Markel et al. |
| 5,392,475 | A | 2/1995 | McCall et al. |
| 5,551,104 | A | 9/1996 | Hartline |
| 5,740,564 | A | 4/1998 | Hankins et al. |
| 5,913,770 | A | 6/1999 | Tseng |
| 6,108,844 | A | 8/2000 | Kraft et al. |
| 6,161,231 | A | 12/2000 | Kraft et al. |
| 6,212,714 | B1 * | 4/2001 | Allen ..... A61G 7/00 5/184 |
| 6,588,837 | B1 | 7/2003 | Schultz et al. |
| 6,687,935 | B2 | 2/2004 | Reeder et al. |
| 6,904,628 | B2 | 6/2005 | Murphy et al. |
| 6,910,236 | B2 | 6/2005 | Rene |
| 6,934,979 | B2 | 8/2005 | Swan |
| 7,040,693 | B1 | 5/2006 | Dorner et al. |
| 7,383,596 | B2 | 6/2008 | James et al. |
| 7,574,758 | B2 | 8/2009 | Arason et al. |
| 8,635,727 | B2 | 1/2014 | Dahlin et al. |
| 2002/0014795 | A1 | 2/2002 | Williams |
| 2004/0211001 | A1 | 10/2004 | Swan |
| 2010/0330330 | A1 * | 12/2010 | Luca ..... B29C 44/5654 428/137 |
| 2011/0167558 | A1 | 7/2011 | Harris |
| 2012/0284492 | A1 | 11/2012 | Henderson et al. |

* cited by examiner

CONVERTIBLE FURNITURE WITH SELECTIVELY EXPANDABLE MATTRESS CUSHION SECTION(S)

This application is a continuation of U.S. patent application Ser. No. 13/771,232, filed Feb. 20, 2013, the contents of which are incorporated herein by reference.

FIELD OF THE INVENTION

The present invention relates generally to foam and other forms of elastic cushioning material used for sofa beds, chairs, ottomans and other pieces of convertible furniture that include a frame and mechanism for storing a cushioned surface or sleeping surface within the piece of furniture, including furniture with a mattress-like surface which, upon expansion, will be of an adequate dimension to function as a mattress. More particularly, the furniture incorporates one or more cushion elements that are selectively expandable in at least one direction to lengthen or widen the cushioned or sleeping surface when the convertible furniture piece is in its unfolded, "open" or sleeping position.

BACKGROUND

The dimensions of the human body require a certain geometry to afford comfort in a sofa or lounge chair. Customarily, seat height is approximately 18 or 19 inches, supportive back height is approximately 14 or 15 inches up from the top of the seat surface, and seat depth is approximately 22 or 23 inches. When the goal is to convert a piece of seating furniture into a sleep surface, these dimensions do not create an adequate sleeping length mattress. To create a standard mattress approximately 78 inches long, many configurations of folded mattress components are possible. The mattress components preferably fit within the body of the piece of seating furniture. To date, when an adequate length sleep surface is achieved, the furniture in its seating mode often can be over-scaled, clumsy and relatively unpleasing in appearance. Also, in order to fit within the furniture piece a mattress of adequate dimensions for a full-size adult to use for sleeping, the mattress's thickness must be reduced to the point of compromising the mattress's comfort.

The unfolding of a cushioned furniture surface to convert, for example, a seating surface into a sleeping surface is currently achieved by unfolding and/or repositioning a supporting frame structure and an accompanying foam cushion. The unfolding or repositioning mechanism may also be used to create a longer seating surface, such as a reclining lounge chair, or for other purposes, such as a doctor's examination table. The unfolding and repositioning of a supporting frame structure is understood in the art and can be accomplished through a variety of known means, including through the use of hinged members, linkages, cables, levers, springs and other simple mechanical devices. Attempts to change the size of elastic foam or cushioned padding, however, present significant problems for a designer.

There are many different types of sofa beds, convertible sofas and other convertible furniture pieces that include a foldable or repositionable frame and a single- or multi-part cushion or mattress positioned within the frame. Basically, the foldable frame and cushion or mattress are configured to fold, rotate, stack and otherwise move so that, in the folded or closed configuration, the cushion or mattress will fit within the volume of the furniture piece and, in the unfolded or open configuration, the cushion or mattress will be supported by the frame and large enough for the intended purpose, for example, sleeping. These convertible furniture pieces, however, can be quite heavy, as the weight of the foldable frame and the associated mechanical linkages and springs—typically of metal—are significant. Several known convertible sofa beds are illustrated in U.S. Pat. Nos. 4,200,941 and 4,176,414.

Other examples of convertible sofa beds incorporate thinner mattresses that can be folded and compressed. The folded and compressed thin mattress then is guided with the portions of the foldable or articulable frame into an interior volume of the sofa bed, typically with at least part of the sofa and frame pivoting upwards and into the interior volume located immediately behind the sofa's back support. This mechanism, however, results in a relatively deep piece of furniture (overall from front to back) when configured in the folded or sitting position, which makes such sofa beds impractical for smaller rooms and aesthetically undesirable. Alternatively, the length of the sleeping surface may extend the length of the sofa, but this results in a sofa with a length (outside arm to opposite outside arm) that is noticeably longer than traditional sofas. Examples of such sofa beds are illustrated in U.S. Pat. Nos. 4,227,268, 4,204,287, 4,086,671, 3,974,529, 3,934,281 and 2,007,988. These and other prior art sofa beds and convertible furniture pieces have generally relied upon folding the foam cushioning, using the frame to reposition it or some combination of the two in order to effect a change in the dimensions of a cushioned or sleeping surface.

In its natural state, any piece of non-rigid, elastic cushioning or foam padding can be compressed or stretched to a certain extent—but with significant, inherent problems. Foam padding that is compressed in length may tend to buckle and bend, and any longitudinal compression may tend to make the foam padding thicker and less compressible in one or more dimensions orthogonal to the direction of compression. Foam padding that is stretched in length does not buckle but may become thinner in one or more dimensions orthogonal to the direction of stretching and then, if stretched too far, will tear or separate. Like many materials, foam padding has a fixed limit of elasticity, and stretching foam beyond this limit results in permanent distortion, deformation, holes or tears in the structure of the foam.

An example of a convertible furniture piece using the compression of non-rigid foam padding is illustrated in U.S. Pat. No. 4,378,609, which shows a sofa bed with a single mattress folded into two sections and then compressed longitudinally to fit the folded sections into the volume beneath and behind the seating cushions typical of a conventional convertible sofa. To compress the mattress once the length is folded in two, the frame includes articulating rigid rails and platforms surrounding the folded foam mattress on all four sides. The non-rigid foam padding is also contained and supported by a rigid platform that acts, in the open position, as a supporting member for the padding and, in the compressed state, as a barrier to contain the compressed foam and prevent buckling or bending in the dimension perpendicular to the direction of compression. The mattress in this construction necessarily is relatively thin so that it not only can be folded onto itself, but also can be compressed within the interior fold of the folded frame. The confinement of the mattress within the interior fold of the folded frame also assists in keeping the mattress from buckling or sliding out of the frame boundaries when it is compressed longitudinally. Because the mattress folds onto itself and then is compressed for storage by being encased in a rigid platform material, the thin mattress may be uncomfortable in the compressed seating configuration because the platform used to contain the foam padding in the compressed state is rigid, thus requiring additional cushions placed on top of the platform for seating. When in the open or unfolded position, the side rails used to contain the cushion in the folded or closed condition also extend upwards from the platform to nearly the top of the foam mattress, resulting in an uncomfortable, rigid edge surrounding the mattress.

Another example of a convertible furniture piece using the compression of non-rigid foam padding is U.S. Pat. No. 6,910,236, which discloses padding with furrows oriented in a direction perpendicular to the direction of compression. As in U.S. Pat. No. 4,378,609, the non-rigid foam padding in U.S. Pat. No. 6,910,236 is also supported on an articulating, rigid base to minimize the buckling of the foam padding when compressed. The patent also discloses the use of a fabric covering secured to the articulating side rails and/or base to contain the remaining three sides of the foam padding during compression. Thus, during compression, the foam padding is confined within a rigid and semi-rigid envelope to reduce the effects of buckling and bending. The foam cushion is also sculpted into a series of furrows or valleys; during compression, the sloping or vertical sides of these valleys in the foam may be pushed together, thereby additionally relieving the tendency of the foam padding to buckle when compressed.

Another approach to convertible furniture is to avoid the use of compressed or stretched foam entirely, as in U.S. Pat. No. 6,904,628, which shows an improved convertible sofa bed with a multiple component mattress having three panels or sections, two of which are folded into a stacked configuration under the seating surface of the sofa and one of which either forms part of the back support of the sofa or folds into an interior volume behind the back support of the sofa. This mechanism permits the use of a thicker and more comfortable mattress material(s), because the mattress is not one contiguous mattress that folds onto itself. Instead, the separate mattress sections pivot and articulate, and one section flips in a reverse direction—so that the mattress sections are located outside of (and are not compressed within) the folded frame. Yet, the mechanism illustrated in this example still uses a relatively large interior volume in the folded, seating or closed orientation, especially below the sofa's seating surface, where two sections of the mattress are stored when folded. The mechanism illustrated in this example also uses a large back support, either formed from part of the mattress or as a fixed surface defining an interior volume where part of the mattress is stored when folded. In either case, the large back support may not be aesthetically desirable.

Improvements to furniture convertible from a "folded," "storage," "closed" or "seating" configuration to an "unfolded," "open" or "sleeping" configuration continue to be sought. In particular, it is desirable to be able to change the size of non-rigid, elastic cushioning or foam padding in a longitudinal dimension while avoiding or minimizing the typical problems associated with folding, compression or elongation of the foam.

SUMMARY OF THE INVENTION

A non-rigid pad, cushion or mattress can be constructed with a plurality of apertures oriented so that the padding material can be elongated or stretched beyond the point where the material without such apertures would otherwise tear or separate. The apertures formed in the padding may be slits, slots, holes, folds, cavities, egg-crate profiles, waffle cut profiles, valleys, furrows or voids, extending either partially or entirely through the thickness of the padding. Such apertures may be formed in a direction orthogonal to a direction of expansion of the mattress section or at any other direction at an angle to the direction of expansion. Alternatively, or in addition, such apertures may be formed in generally parallel rows that extend substantially across a top surface of the mattress section. Alternatively, or in addition, apertures may be formed in a top surface of the mattress section, and other apertures may be formed in a bottom surface of the mattress section. Alternatively, the apertures may be formed primarily only in one portion of the top surface, or primarily only in one portion of the bottom surface. Alternatively, the padding, cushion or mattress may be formed from a plurality of layers or sections of material with apertures included in any portion or all of the plurality of layers.

With the inclusion of such apertures in the padding, cushion or mattress, the apertures expand when the mattress is elongated and permit the mattress material to be stretched beyond a point where the same material would tear, separate, distort or become damaged in the absence of such apertures. The apertures permit the construction of a convertible furniture piece that uses elongation or stretching of a non-rigid, elastic cushion or foam mattress instead of compression (and the accompanying limiting frame or structure used to contain the foam cushion in its compressed state). Thus the use of cushions with apertures to permit elongation is distinguished from known furniture pieces that rely on compressing the cushion or foam within a rigid or semi-rigid frame in order to achieve a change in dimension. The use of apertures for elongation according to the invention also minimizes the amount of force or effort needed to elongate the foam from its natural, unstretched state and results in a cushion that retains substantially the same width and depth when elongated.

An article or piece of furniture that is convertible from a storage or seating position to a sleeping position may include a first frame having a first frame section and a second frame section wherein at least one of the first frame section and second frame section is translatable from a first position where the first frame section and second frame section contact one another or are close to one another to a second position wherein the first frame section and second frame section are moved away, separated or translated in respect to one another. The first frame section and second frame section may be slidably engaged to one another. For example, the first frame section may define at least one channel or receiving hole to receive the support and the second frame section may define at least one other channel or other receiving hole to receive the support, and the first frame section and second frame section may translate by sliding movement along the support. Alternatively, the first frame section and the second frame section may include an articulated connection between them.

The first frame with first frame section and second frame section supports at least one cushion or mattress section defining at least a portion of a sleeping surface, for example. The at least one mattress section has a first length and a first width and a first thickness when said convertible furniture article is in the storage or seating position. The at least one mattress section includes a plurality of apertures extending into or through the mattress section that are cut at any angle different from or orthogonal to the direction of the first length of the mattress section. The direction of the first length of the mattress section is the direction in which the mattress section will be stretched or expanded. The mattress section is expandable from its first length to a second length that is longer than the first length when said convertible furniture article is opened to the sleeping position. The mattress section is joined to the first frame section and joined to the second frame section so that translating movement of the first frame section or second frame section in relation to the other frame section expands the mattress section from its first length to its second length. Preferably, the sleeping surface of the mattress section has a generally planar configuration when said mattress section is at its first length, and said sleeping surface has a generally planar configuration when said mattress section is expanded to its second length.

The mattress or cushion section may be formed of any resilient, non-rigid or semi-rigid material that serves a cushioning function. Representative resilient materials include, but are not limited to, polyurethane foam, viscoelastic foam, latex foam and other fibrous or elastic materials used for cushioning.

In another embodiment, the article of furniture includes more than one mattress section that is expandable from its first length to a second length that is longer than the first length when said convertible furniture article is opened to the sleeping position. For example, a second mattress section and/or a third mattress section and/or other cushion or mattress sections may be incorporated into the article of furniture. Each such expandable cushion or mattress section may be formed of a resilient material with apertures, and each may be joined to translatable frame sections.

The cushion or mattress section may be covered by a protective layer. One suitable protective layer comprises a stretchable fabric that covers the top surface and/or the bottom surface of the mattress section.

In a closed position, the article of furniture may comprise a sofa, a chair, an ottoman, a stool, a loveseat, a daybed, a Murphy bed, a footrest, a bench, a table, or the like. All articles of size-convertible or expandable furniture are within the scope of the invention. Additional cushions or features may be included with the article of furniture such as, but not limited to, bolster cushions, seat cushions, back cushions, footrests and side panels.

In another aspect, a size-convertible cushion, mattress or mattress section has at least one mattress section defining at least a portion of a sleeping surface and having a first length and a first width and a first thickness when said mattress or mattress section is in a storage or seating position. The mattress section defines a plurality of apertures extending into or through the mattress section that are cut in a direction at an angle to the first length of the mattress section. The mattress section is expandable from its first length to a second length that is longer than the first length when said mattress or mattress section is opened to a sleeping position. The sleeping surface of the mattress section preferably has a generally planar configuration when said mattress section is at its first length, and a generally planar configuration when said mattress section is expanded to its second length.

DESCRIPTION OF THE DRAWINGS

The advantages of this invention will be more readily apparent from the following description of the drawings in which.

DESCRIPTION OF THE PREFERRED EMBODIMENTS

Figure 1:
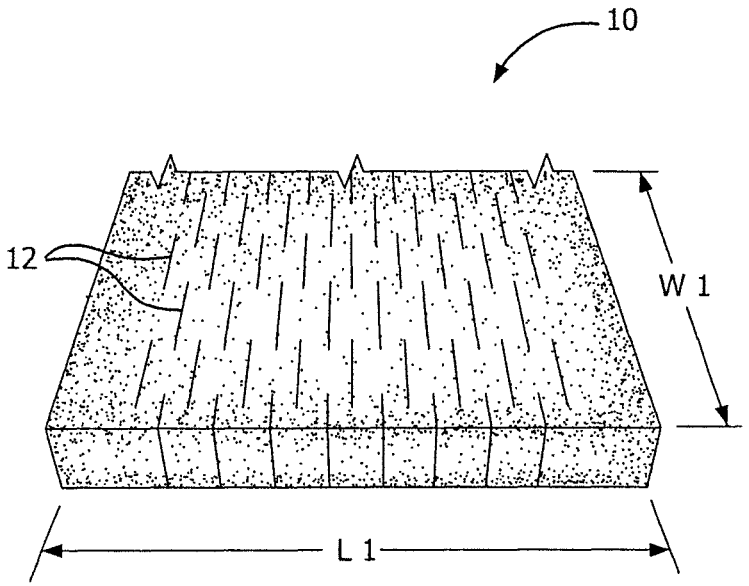
FIG. 1 is an end perspective view of a first embodiment of a cushion or mattress section.
Figure 2:
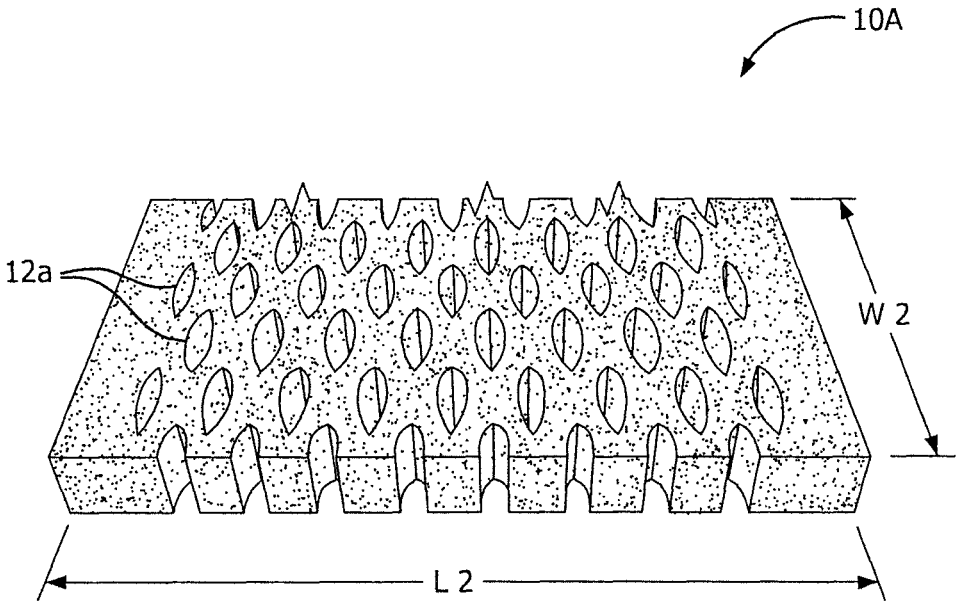
FIG. 2 is an end perspective view of the first embodiment of a cushion or mattress section of FIG. 1 shown in an expanded position.

Referring first to FIGS. 1 and 2, a mattress section or cushion 10 has a first width W1 and first length L1 identified in FIG. 1. When the mattress section or cushion 10A is stretched or pulled in the direction of its length, slits 12 cut through the mattress section or cushion material expand open to form holes or opening 12*a*. The mattress section or cushion 10A has an elongated length L2 after it has been stretched (see FIG. 2). Notwithstanding the expansion or elongation of the foam, the mattress section or cushion retains its generally planar top surface. Moreover, depending upon the amount of stretch, the width W2 of the mattress section or cushion may be substantially the same or comparable to the width W1 of the mattress section or cushion pre-stretch or pre-expansion.

As illustrated in FIGS. 1 and 2, the mattress section or cushion 10, 10A is formed of a resilient, stretchable or flexible material with sufficient cushioning and body supporting properties. One suitable resilient material is foam, such as a polyurethane foam or a latex foam or other expanded cellular polymer with cushioning properties customarily used in bedding and furniture applications. Polyurethane foams are widely used in the construction of furniture and bedding, particularly mattresses, mattress toppers or pads, seating cushions and other cushioning components.

Representative polyurethane foams include conventional polyether foams as well as high resiliency polyether foams. High resiliency polyether polyurethane foams generally have sag factors at least approximately 10% higher than conventional polyether polyurethane foams. The polyurethane foam of the mattress section or cushion 10, 10A may have a density in the range of 1.0 pcf to 6.0 pcf, more particularly 1.5 pcf to 3.0 pcf. Viscoelastic foams with densities from about 3.0 pcf to about 6.0 pcf also may be used.

Bedding constructions that include viscoelastic foams have become very popular not only for medical and orthopedic applications, but also for home use. Viscoelastic foams exhibit slower recovery when a compression force is released than other resilient polyurethane foams. For example, after being released from compression, a resilient polyurethane foam at room temperature and atmospheric conditions generally recovers to its full uncompressed height or thickness in one second or less. By contrast, a viscoelastic foam of the same density and thickness, and at the same room temperature condition, will take significantly longer to recover, even from two to sixty seconds. The recovery time of viscoelastic foams is sensitive to temperature changes within a range close to standard room temperature. Slow recovery foams also exhibit ball rebound values of generally less than about 20% as compared to about 40% or more for other foams.

Other fibrous, resilient, elastic or elastomeric cushioning materials may also be used, either alone or in combination with foams.

Figure 21A:
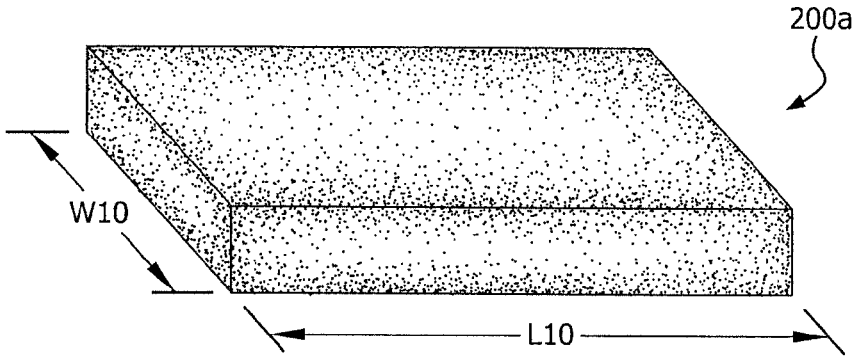
FIG. 21A is an end perspective view of a prior art cushion or mattress section without apertures and without any compression or stretching force applied.
Figure 21B:
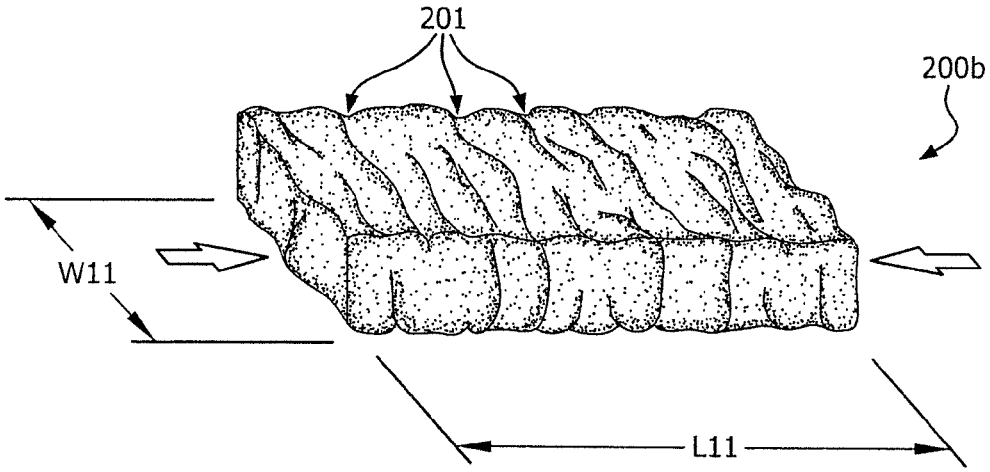
FIG. 21B is an end perspective view of the prior art cushion or mattress section of FIG. 21A subject to compression.
Figure 21C:
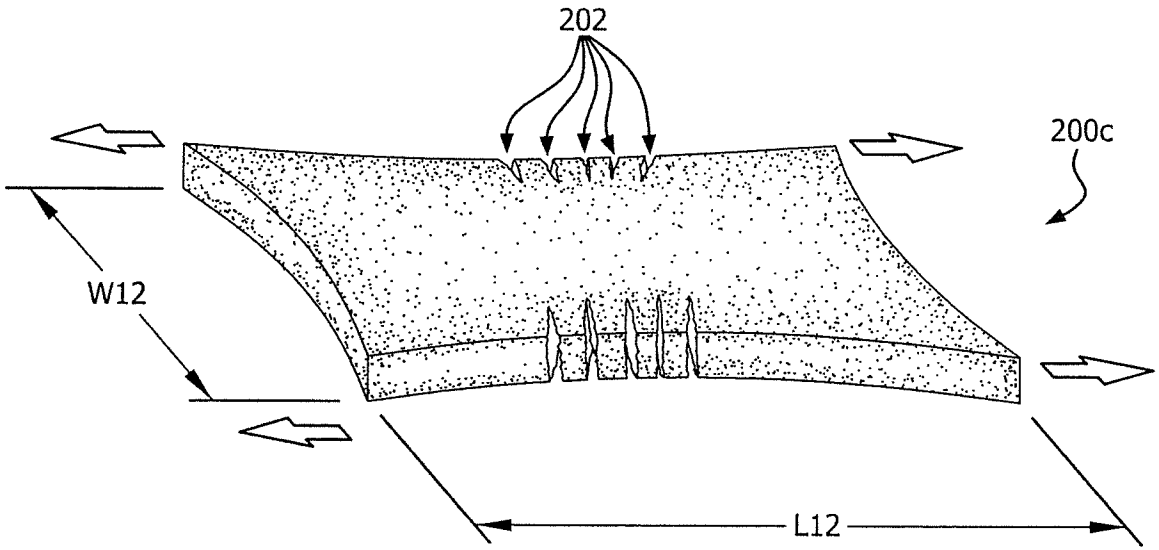
FIG. 21C is an end perspective view of the prior art cushion or mattress section of FIG. 21A subject to stretching.

Referring to FIGS. 21A, 21B and 21C, it is apparent that prior art mattress sections or cushions present significant disadvantages when compressed or stretched. A prior art mattress section 200*a* with no compression or stretching forces acting upon it has a first width W10 and a first length L10, as shown in FIG. 21A. When the prior art mattress section 200*b* is compressed, the mattress section can be collapsed to a second length L11, but the mattress section will have an uneven, wrinkled and folded appearance 201 and a tendency to buckle or bend, as shown in FIG. 21B. The compressed mattress section 200*b* will also be more rigid (and less comfortable) as a seating or sleeping surface in its compressed state and, unless restrained by some form of surrounding frame or envelope, the compressed mattress section may bend and spring outwards suddenly in a direction different from the direction of compression. Alternatively, when the prior art mattress section 200*c* is stretched or pulled, the mattress section can be elongated to a third width W12 and a third length L12, as shown in FIG. 21C. The mattress section 200*c* may be stretched slightly in length up to the limit of the mattress section's inherent limit of elasticity, but stretching the mattress section beyond this point may result in ripping, tearing, separation or other permanent distortion or damage to the material 202. During both compression and stretching, the second width W11 and third width W12 may differ from the mattress section's original width W10, which is not desirable in a furniture piece. The present invention provides a means for avoiding the problems shown in FIGS. 21A through 21C.

The invention is useful for various articles or pieces of furniture, including, but not limited to, sofas, chairs, ottomans, stools, loveseats, daybeds, Murphy beds, footrests, benches, tables, or the like. As stated previously, all articles of size-convertible or expandable furniture are within the scope of the invention. Additional cushions or features may be included with the article of furniture such as, but not limited to, bolster cushions, seat cushions, back cushions, footrests and side panels.

Figure 3:
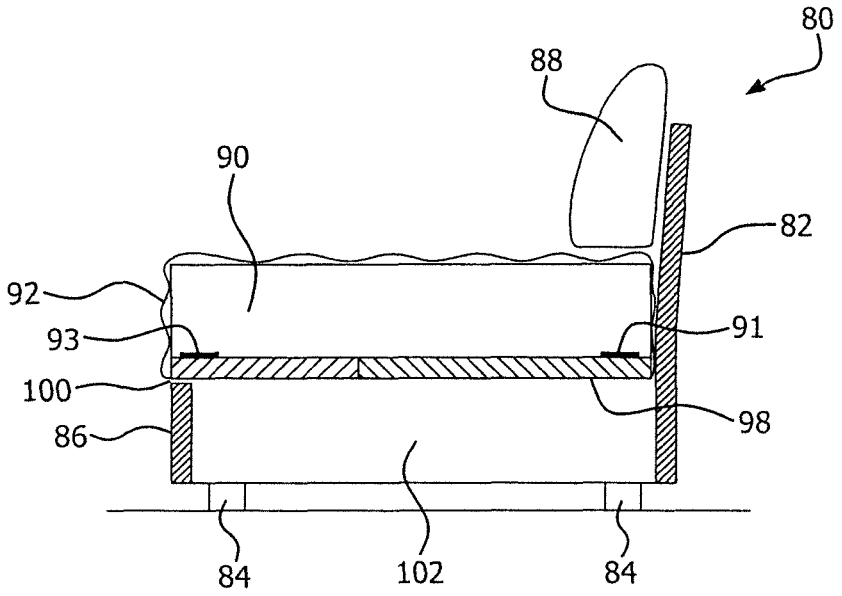
FIG. 3 is a right facing side elevational view in partial cross section showing a first embodiment of an article of furniture according to the invention, which article of furniture is shown in the closed or seating position.
Figure 4:
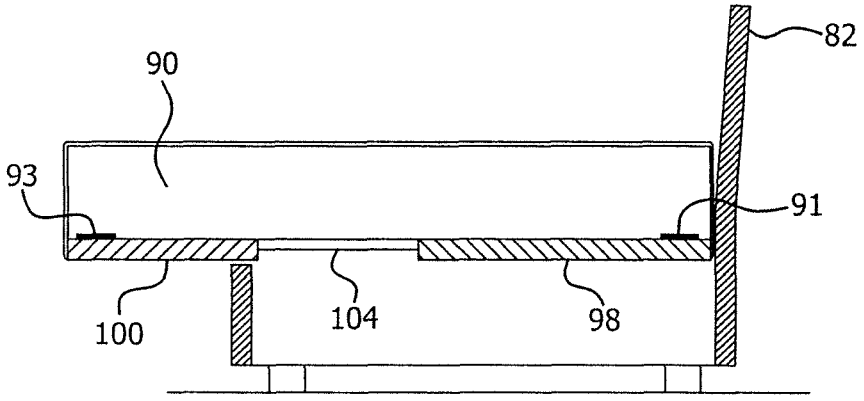
FIG. 4 is a right facing side elevational view in partial cross section of the article of furniture of FIG. 3, shown in a fully opened or sleeping position.
Figure 5A:
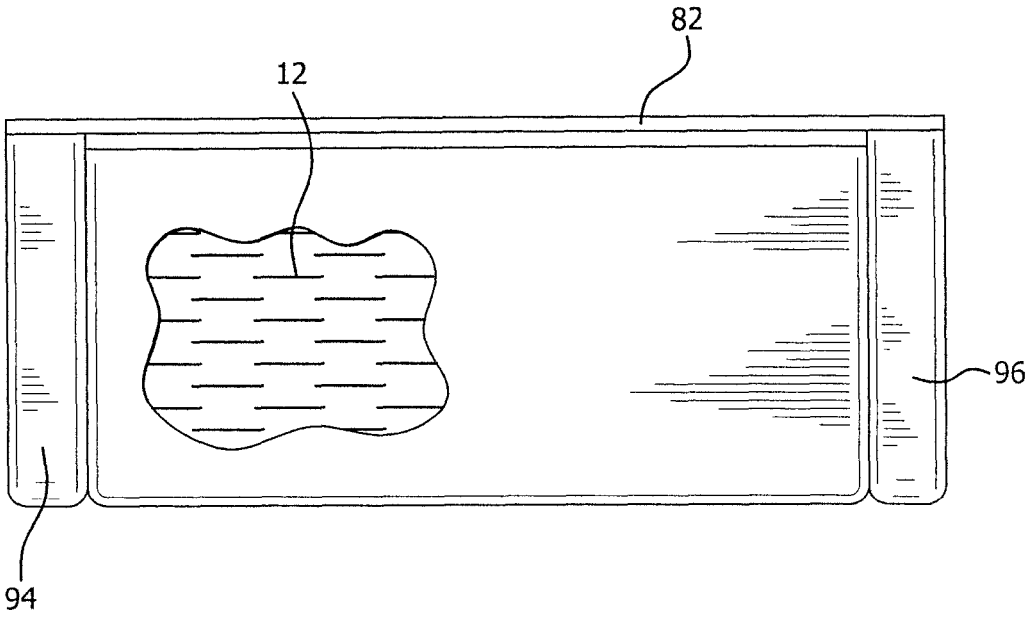
FIG. 5A is a top plan view of the article of furniture of FIG. 3 shown in the closed or seating position.

Referring now to FIGS. 3-5, a convertible sofa 80 has a back frame 82 and a front frame 86 and is supported by legs 84. A mattress section 90 forms the seating surface of the sofa 80 in the seating or closed (storage) configuration. The mattress section may be a polyurethane foam with apertures such as but not limited to the slits in the mattress section 10, 10A shown in FIGS. 1 and 2. The mattress section 90 may be covered by a casing, fabric or a topper 92. A back bolster 88 is installed over the mattress section 90 and adjacent to the inner surface of the back frame 82. Optionally, the back bolster 88 is releasably engaged, such as with hook and loop fasteners (Velcro) to the back frame 82. Arm rests 94, 96 may be included at the sides of the sofa 80. The space between the arm rests 94, 96 corresponds generally to the length of a standard twin bedding mattress (e.g. approx. 78 inches).

The mattress section 90 is joined to a first frame section 98 and second frame section 100, such as by adhesive 91, 93. Alternatively, the mattress section 90 may be film bonded or flame laminated to the first frame section 98 and second frame section 100. The first frame section 98 and second frame section 100 are joined or linked to a support 104. At least one of the first frame section 98 or second frame section 100 is slidably engaged to the support 104.

Figure 5B:
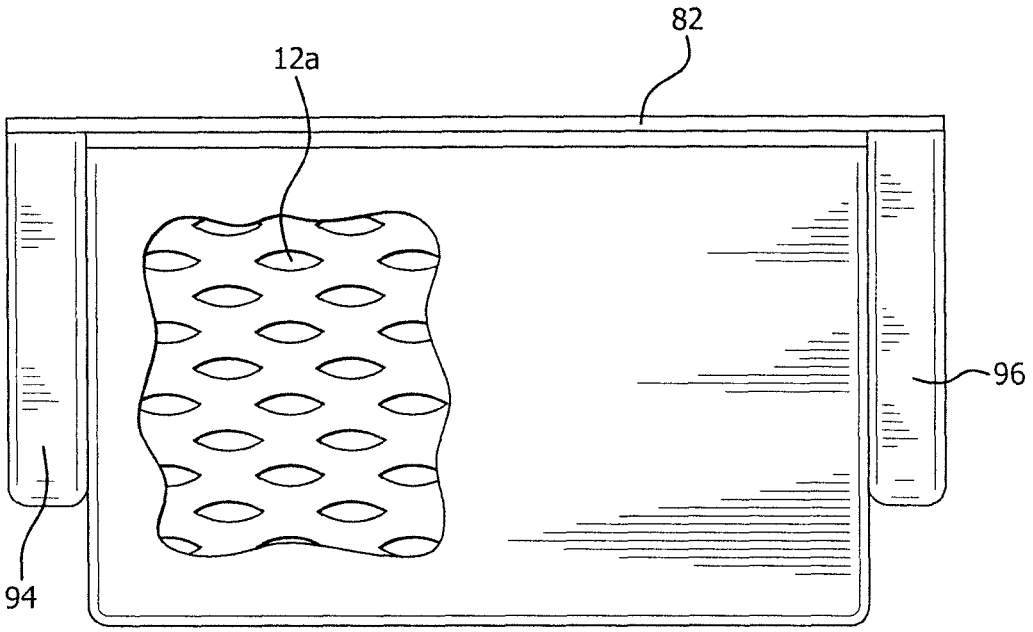
FIG. 5B is a top plan view of the article of furniture of FIG. 4 shown in the fully opened or sleeping position.

In this embodiment, the convertible sofa 80 may be altered from a seating or closed (storage) configuration (FIGS. 3 and 5A) to an open or sleeping configuration (FIGS. 4 and 5B) by expanding the mattress section 90 outwardly from the front frame 86. The user expands the mattress section 90 by applying a pulling or stretching force to the second frame section 100 to move away or separate the second frame section 100 from the first frame section 98 and thereby extend the width of the mattress from a seating width (e.g., about 30 inches) to a mattress width (e.g. about 39 inches). This expansion of the mattress section from a seating width to a sleeping width is enabled by the opening of apertures 12, 12*a* in the mattress. In this embodiment, the mattress section 90 remains in its same top surface up orientation, and the top surface forms a seating surface in the seating or closed configuration (FIGS. 3 and 5A) and a widened sleeping surface in the open or sleeping configuration (FIGS. 4 and 5B).

Figure 19:
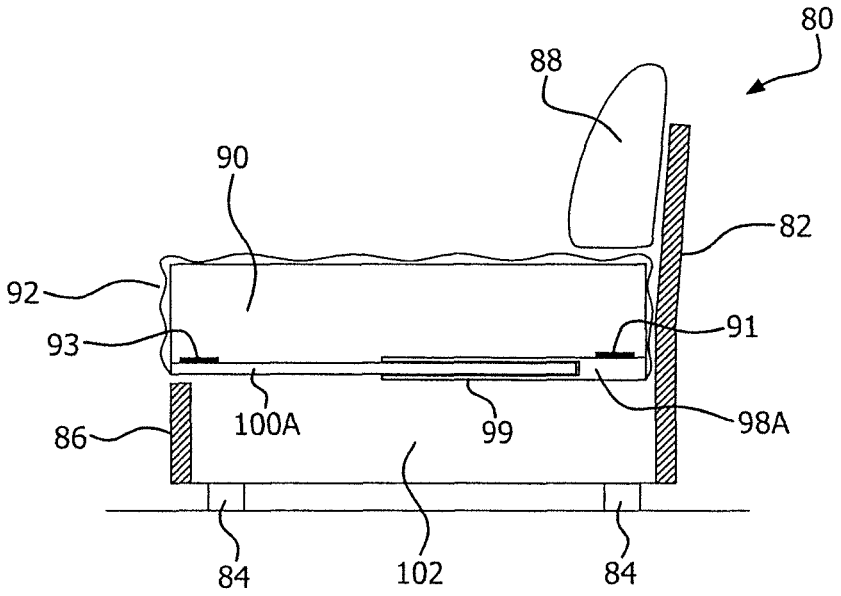
FIG. 19 is a right facing side elevational view in partial cross section showing an alternative to the article of furniture shown in FIG. 3, in which the first and second frame sections include an articulated connection.
Figure 20:
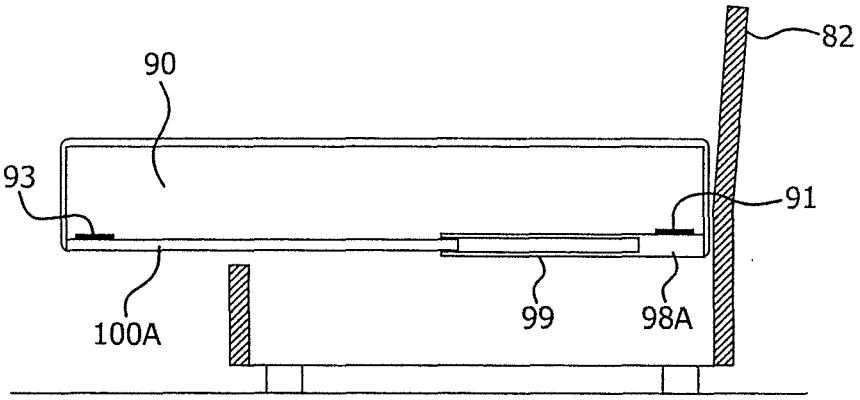
FIG. 20 is a right facing side elevational view in partial cross section of the article of furniture of FIG. 19, shown in a fully opened or sleeping position.

FIGS. 19 and 20 show alternative first and second frame sections 100A and 98A. The alternative first frame section 98A includes an articulated connection element 99 such that in the closed or seating (storage) position (FIG. 19), a portion of the second frame section 100A is slidably engaged within element 99 of the first frame section 98A. In the open or sleeping position (FIG. 20), the sliding movement of the second frame section 100A away from the first frame section 98A causes the mattress section 90 to expand. The portion of the second frame section 100 is shown to be still supported by the articulated connection element 99 when the article of furniture is in the open or sleeping position (FIG. 20).

Figure 6A:
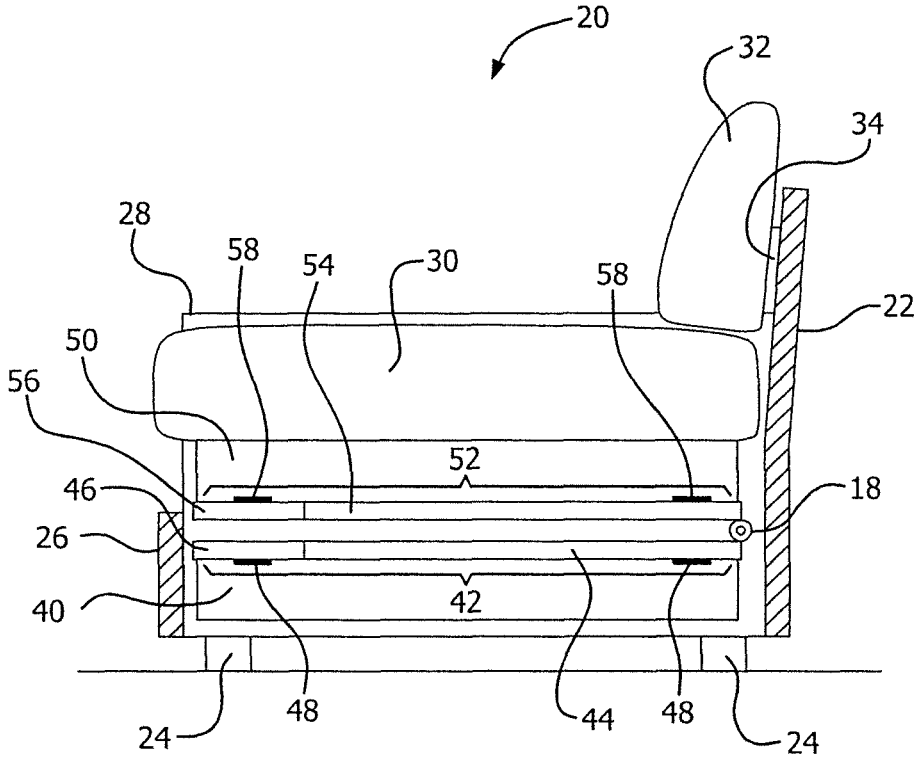
FIG. 6A is a right facing side elevational view in partial cross section showing a second embodiment of an article of furniture according to the invention, which article of furniture is shown in closed or seating position.
Figure 6B:
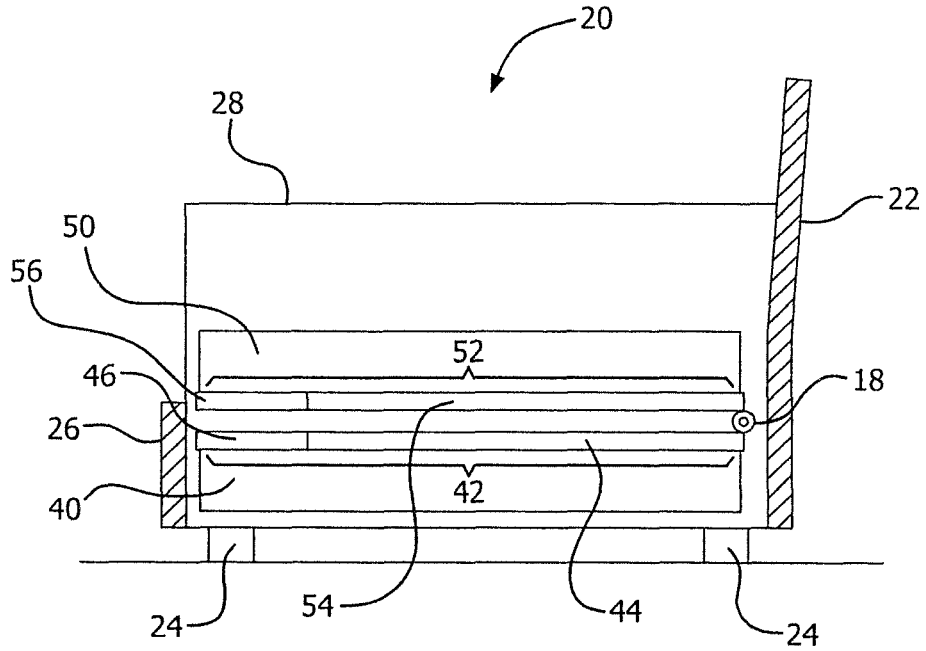
FIG. 6B is a right facing side elevational view in partial cross section showing the article of furniture of FIG. 6A with bolster cushion and seat cushion removed.
Figure 10:
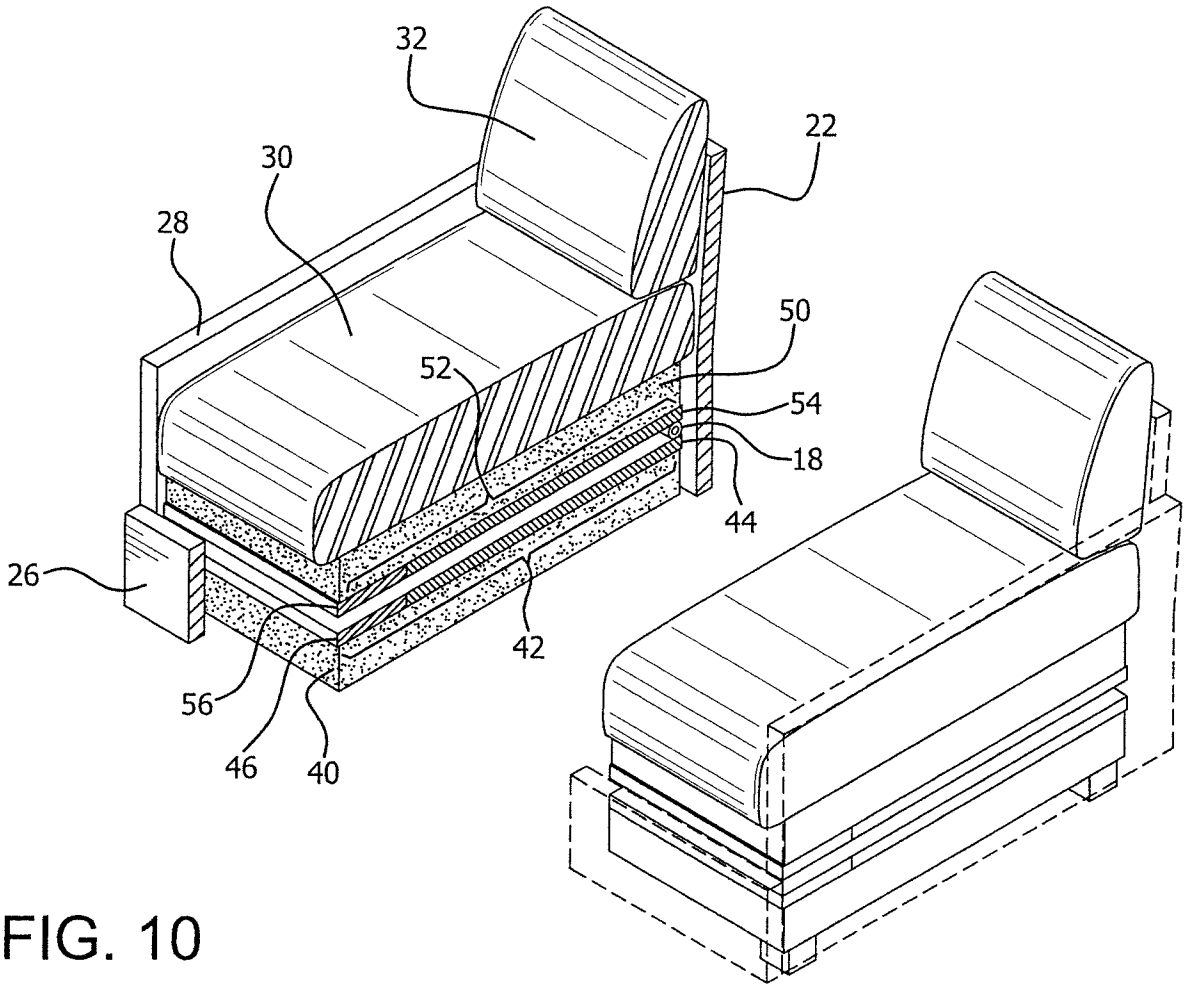
FIG. 10 is a right front perspective view in partial cross section to show interior components, and with a right side of a frame in phantom outline.

Referring next to FIGS. 6A, 6B and 10, a convertible sofa 20 includes a back frame 22 and a front frame 26 and side frames 28. The sofa 20 is supported on a floor surface or other mounting surface by legs 24. The convertible sofa 20 is shown in FIG. 6A in a first closed or seating position, with mattress sections 40, 50 contained within the volume space between the back frame 22 and front frame 26 and side frames 28. The mattress sections 40, 50 comprise support for the seat cushion 30 and back bolster 32. Optionally, the back bolster 32 is removably connected, such as by hook and loop fasteners (Velcro) or other connector means 34, to a portion of the inner face of the back frame 22. Of course, a designer may opt not to include the seat cushion 30 and/or the back bolster 32 in the construction of a convertible sofa. In such a case, the mattress section 50 may comprise a sofa seating surface.

In the closed or seating position, the first mattress section 40 is inverted and held below the second mattress section 50 within the volume space of the sofa. The first mattress section 40 may comprise foam that has been cut with a series of apertures in the form of slits, such as but not limited to the mattress section shown in FIGS. 1 and 2. The bottom surface of the first mattress section 40 is joined to a first frame 42, which is formed by a first frame section 44 and a second frame section 46. Joining may be with adhesive, such as adhesives based on styrene block copolymers, ethylene vinyl acetate copolymers, nitriles and rubbers. At least portions of the bottom surface at each end of the first mattress section 40 are coated with adhesive 48 and then placed in contact with the surface of the first frame section 44 and second frame section 46 respectively. Joining alternatively may be by fasteners or other connector means, such as by hook and loop fasteners (Velcro), or any other suitable means for attaching a foam mattress to a rigid or semi-rigid furniture frame.

Optionally, not shown in FIGS. 6A-10, the first mattress section 40 may be covered by a fabric casing, topper or ticking. Representative fabric casing or ticking materials include: bilaminate nylon knit/polyurethane film, nylon taffeta, polyurethane film, bilaminate polyurethane film, polyester, and others.

In the closed or seating position, the second mattress section 50 is shown in an upwardly facing orientation with its top surface abutting a bottom surface of a seat cushion 30. The second mattress section 50 may comprise foam that has been cut with a series of apertures in the form of slits, such as but not limited to the mattress section shown in FIGS. 1 and 2. The bottom surface of the second mattress section 50 is joined to a second frame 52, which second frame has a first frame section 54 and a second frame section 56. Joining may be with adhesive, such as adhesives based on styrene block copolymers, ethylene vinyl acetate copolymers, nitriles and rubbers. Joining alternatively may be by fasteners or other connector means, such as by hook and loop fasteners (Velcro) or any other suitable means for attaching a foam mattress to a rigid or semi-rigid furniture frame. At least portions of the bottom surface at each end of the second mattress section 50 are coated with adhesive 58 and then placed in contact with the surface of the first frame section 54 and the second frame section 56. The second frame 52 is rotatably movably linked to the first frame 42 of the first mattress section 40 by hinge 18.

Figure 7:
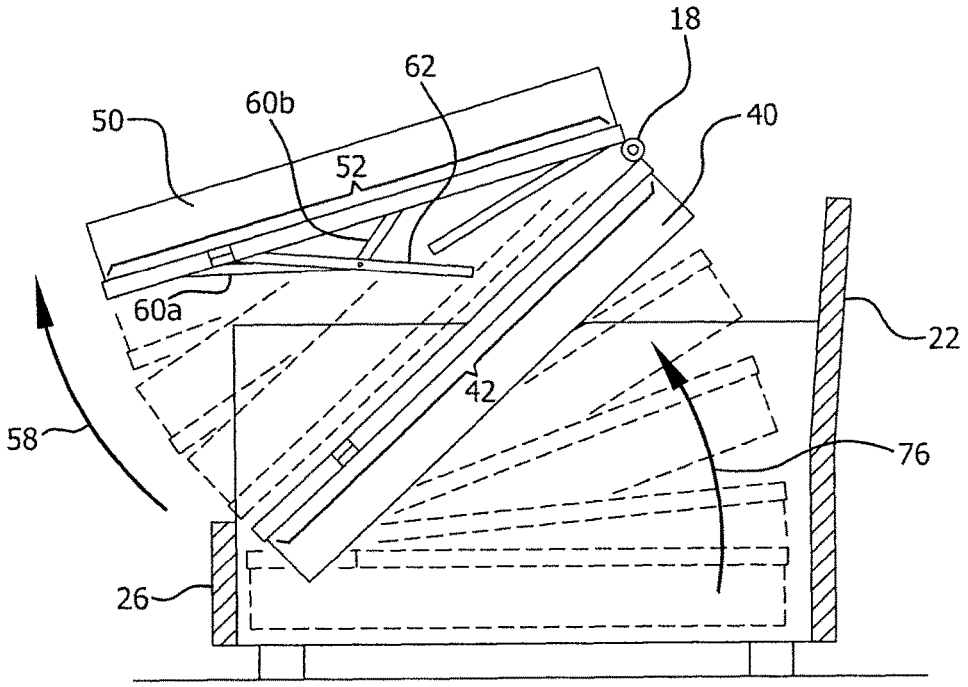
FIG. 7 is a right facing side elevational view in partial cross section of the article of furniture of FIGS. 6A and 6B, shown in a first partially opened position.

To convert the sofa 20 from a closed or seating configuration (FIG. 6A) to an open or sleeping configuration (FIG. 9), first, the bolster cushion 32 and seat cushion 30 are removed (compare FIG. 6B with FIG. 6A). Next, referring to FIG. 7, the second mattress section 50 is raised upwardly and outwardly from the volume space within the front frame 26 and back frame 22 of the sofa 20. Arrow 58 in FIG. 7 shows the direction of the vertical and slightly rotational movement of second mattress section 50 and second frame 52 (frame sections 54, 56) emerging from the volume space.

Figure 8:
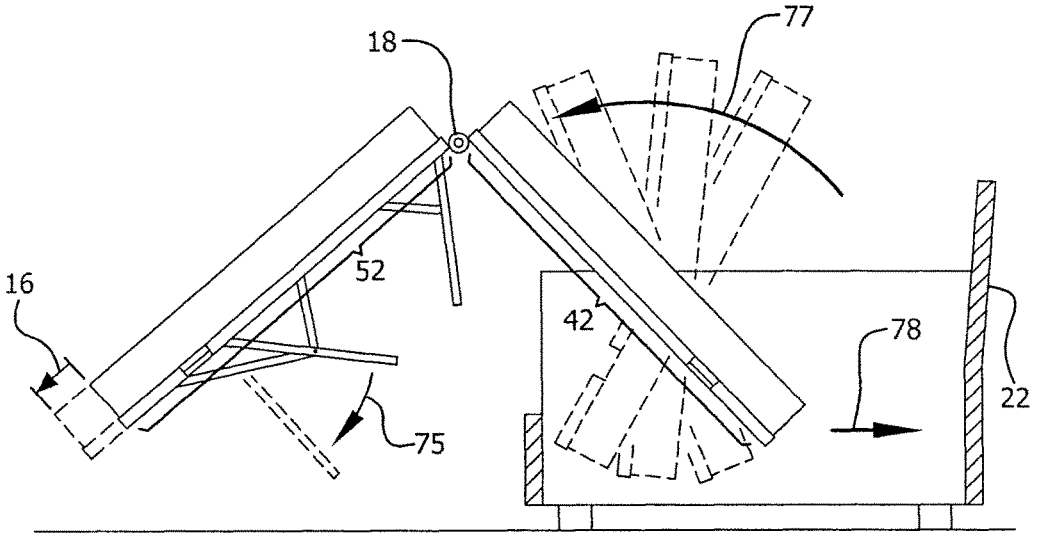
FIG. 8 is right facing side elevational view in partial cross section of the article of furniture of FIGS. 6A and 6B, shown in a second partially opened position.
Figure 9:
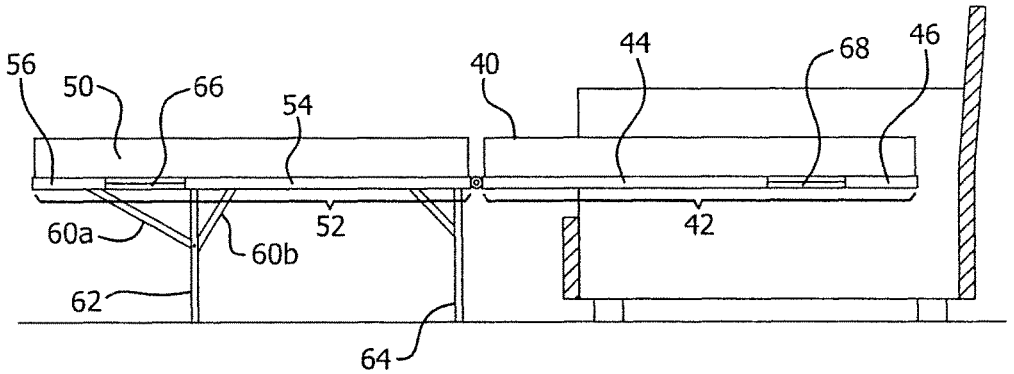
FIG. 9 is a right facing side elevational view in partial cross section of the article furniture of FIGS. 6A and 6B, shown in fully opened or sleeping position.

Support legs 62 are connected by linkages 60*a* to the bottom surface of the second frame 52 (frame sections 54, 56) at frame section 56 and to linkages 60*b*. Referring to FIGS. 7 and 8, as the second mattress section 50 and second frame 52 (frame sections 54, 56) are moved out of the volume space within the front frame 26 and back frame 22 of the sofa 20, the support legs 62 may be moved in direction of arrow 75 (FIG. 8) by driving linkages 60*b*. The driving force is imparted by the geometry of the unfolding of the frames 42 and 52 (mechanism not shown). The second mattress section 50 may be enlarged or expanded in the direction and to the extent shown by arrow 16 in FIG. 8, when the second frame section 54 is separated from the first frame section 56 by some distance as exemplified in FIG. 8. As shown in FIG. 9, this end (at arrow 16 in FIG. 8) of the second mattress section 50 forms the foot of the sleeping surface when the sofa is in the open or sleeping configuration. The sleeping surface of the second mattress section 50 remains substantially planar in both the open (sleeping) and closed (seating) configurations.

Concurrently, the first mattress section 40 rotates in the direction of arrows 76 (FIG. 7) and 77 (FIG. 8) to flip the first mattress section 40 from its "top surface down" orientation in the closed or seating configuration of the sofa, to its "top surface up" orientation for the open or sleeping configuration. One end of the first mattress section 40 moves closer to the inner surface of the back frame 22 in the direction of arrow 78 (FIG. 8) and forms the head of the sleeping surface in the open or sleeping configuration. The first frame 42 and second frame 52 rotate about hinge 18 as shown in FIG. 8. When the mattress is in the open or sleeping configuration, one end of the first mattress section 40 is positioned adjacent one end of the second mattress section 50 (FIG. 9).

Optionally, as shown in FIG. 9, the first mattress section 40 may be enlarged or expanded by moving apart the second frame section 46 from the first frame section 44. The length of the first mattress section 40 thus is longer in the open or sleeping configuration (FIG. 9) than the length of the first mattress section 40 when in the closed or seating configuration (FIGS. 6A and 6B).

Linkages (not shown) between the first frame 42 and the supporting construction of the sofa (not shown) maintain the first mattress section 40 and first frame 42 (frame sections 44, 46) within the space between side frames 28. A representative linkage system is disclosed in U.S. Pat. No. 6,904,628, the contents of which are incorporated herein by reference. When in the open or sleeping configuration (FIG. 9), the first frame 42 (first frame section 44 and second frame section 46) and first mattress section 40 are supported by the supporting construction of the sofa and its mechanism. The second frame 52 (first frame section 54 and second frame section 56) and second mattress section 50 are supported by legs 62 and 64. Similar to the mechanism driving movement of legs 62, the legs 64 also move from the volume space within the front frame 26 and back frame 22 of the sofa 20 by means of a driving mechanism (not shown) linked to the unfolding of the frames 42 and 52.

Figure 11:
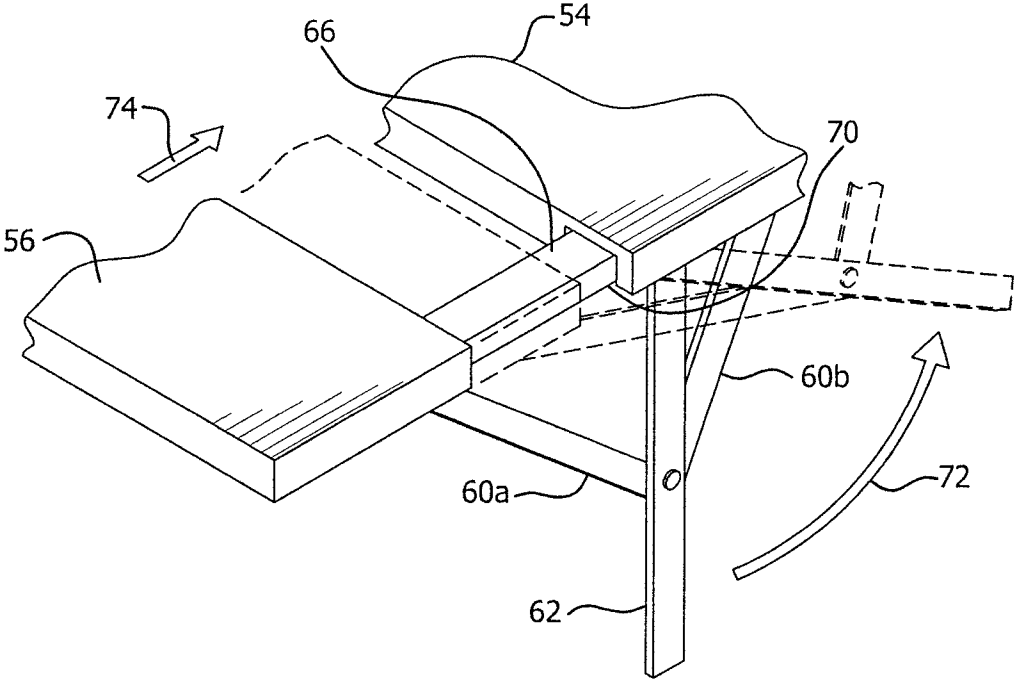
FIG. 11 is a right front perspective view of a support frame linkage and expandable supporting platform sections to support a mattress section in a fully opened or sleeping position wherein the support frames have been driven apart.

One mechanism for enlarging or expanding the mattress sections is shown in FIG. 11. The first frame section 54 and second frame section 56 of the second frame 52 are movably connected to a support 66. In FIG. 11, the support 66 is a rail or bar or beam. Engaging channels 70 are formed in each of the first frame section 54 and second frame section 56 to receive the support 66. In one embodiment, both frame sections 54, 56 are slidably engaged to the support. In another embodiment, one of the frame sections 54, 56 is slidably engaged to the support 66.

The convertible sofa may be converted from the sleeping position (shown in FIG. 9) to the seating position (shown in FIGS. 6B and 10). To close the convertible sofa to the seating position, the frame sections are slid to a closed position. As shown in FIG. 11, the second frame section 56 slides in the direction of arrow 74 to shorten the length of the second frame 52 and correspondingly remove the stretching force applied to the second mattress section 50, collapsing its length from its expanded or stretched length L2 to its unexpanded length L1 (not shown in FIG. 11). Similarly, if the first frame 42 expanded the length of the first mattress section 40, at least one of the first frame section 44 and the second frame section 46 are slid so that the frame sections 44, 46 are again adjacent to or abutting one another, thereby removing the stretching force applied to the first mattress section 40 and collapsing its length from an expanded or stretched length L2 to an unexpanded length L1 (also not shown in FIG. 11). The leg 62 and corresponding linkage 60*a* are rotated by the driving force of linkage 60*b* in the direction of arrow 72 in FIG. 11 to a closed position.

Referring next to FIGS. 12A-15, a convertible chair or sofa 110 has three mattress sections 124, 136, 140 that are held within the volume space of the chair or sofa 110 when in the closed or seating configuration. In this embodiment, the chair 110 has a back frame 112 and a front frame 116 and is supported over a floor surface by legs 114. The chair also has side frames or arm rests 118. A seat cushion 120 and back bolster cushion 122 are removably installed over the mattress sections when the chair 110 is in the closed position.

A first mattress section 124 is joined to a first frame section 126 and a second frame section 128. A second mattress section 136 is joined to a second frame 138. A third mattress section 140 is joined to a third frame 142. The first frame 126 is joined to the second frame 138 by linkage 132 to facilitate rotational movement between the first frame 126 and the second frame 138. The second frame 138 is joined to the third frame 142 by hinge 134 to facilitate rotational movement between the second frame 138 and the third frame 142.

Figure 15:
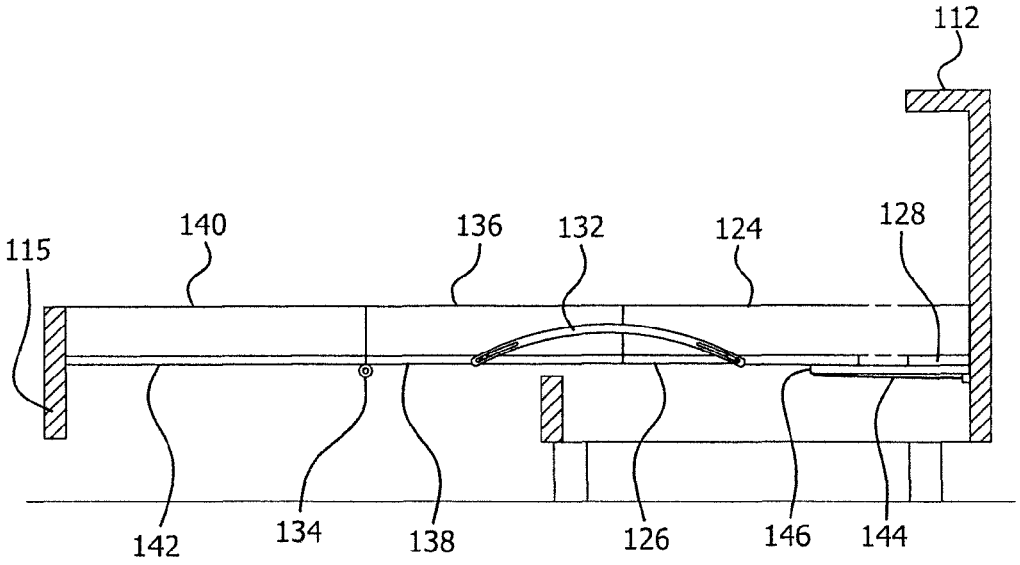
FIG. 15 is a right facing side elevational view in partial cross section of the article of furniture of FIG. 12B in fully opened or sleeping position.

A front border 115 is joined to or extends from the third frame 142 at an end opposite to that where the third frame 142 is connected to hinge 134. The front border 115 optionally forms a front facing for the chair when the chair is in the seating or closed configuration (FIG. 12A) and supports the third frame 142 and third mattress section 140 when the chair is in the open or sleeping configuration (FIG. 15).

An added support element 146 is installed onto the first frame section 128. A cable or linkage 144, attached at one end to the back frame 112 and at the other end to the added support element 146, acts on the first frame section 128 through the added support element 146 to separate the first frame section 128 from the second frame section 130 and to apply a stretching force to the first mattress section 124 when the chair 110 is converted from its closed or seating configuration (FIG. 12B) to its open or sleeping configuration (FIG. 15). The pulling or stretching force applied to the added support frame 146 and thus to the first frame section 128 causes the first mattress section 124 to expand in length from its first length L1 from the closed or seating configuration (FIGS. 12A, 12B) to its second or expanded length L2 of the open or sleeping configuration (FIG. 15) by opening of apertures (not shown) cut into the first mattress section 124.

The rotational movement of the third mattress section 140 and the second mattress section 136 is comparable to the movement of the two mattress sections shown in FIGS. 6A-10. The second mattress section 136 is inverted from its "top side down" orientation in the closed or seating configuration to its "top side up" orientation in the open or sleeping configuration. The third mattress section 140 is moved outside the volume space defined between the front frame 116 and back frame 112.

Figure 12A:
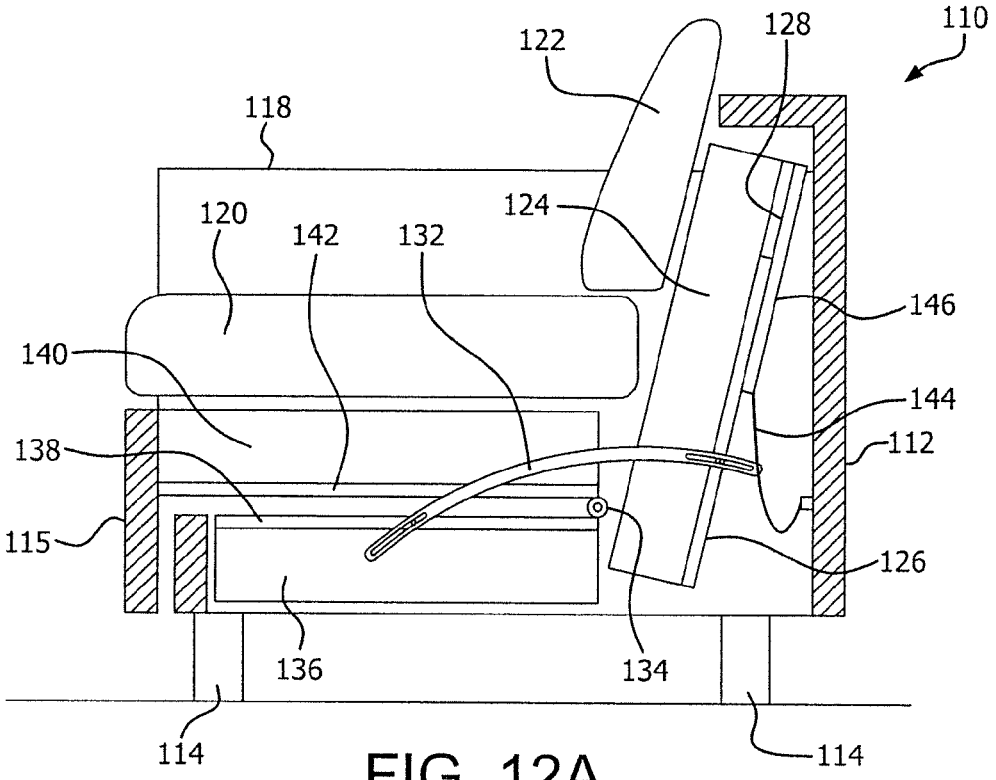
FIG. 12A is a right facing side elevational view in partial cross section showing a third embodiment of an article of furniture according to the invention, which article of furniture is shown in the closed or seating position.
Figure 12B:
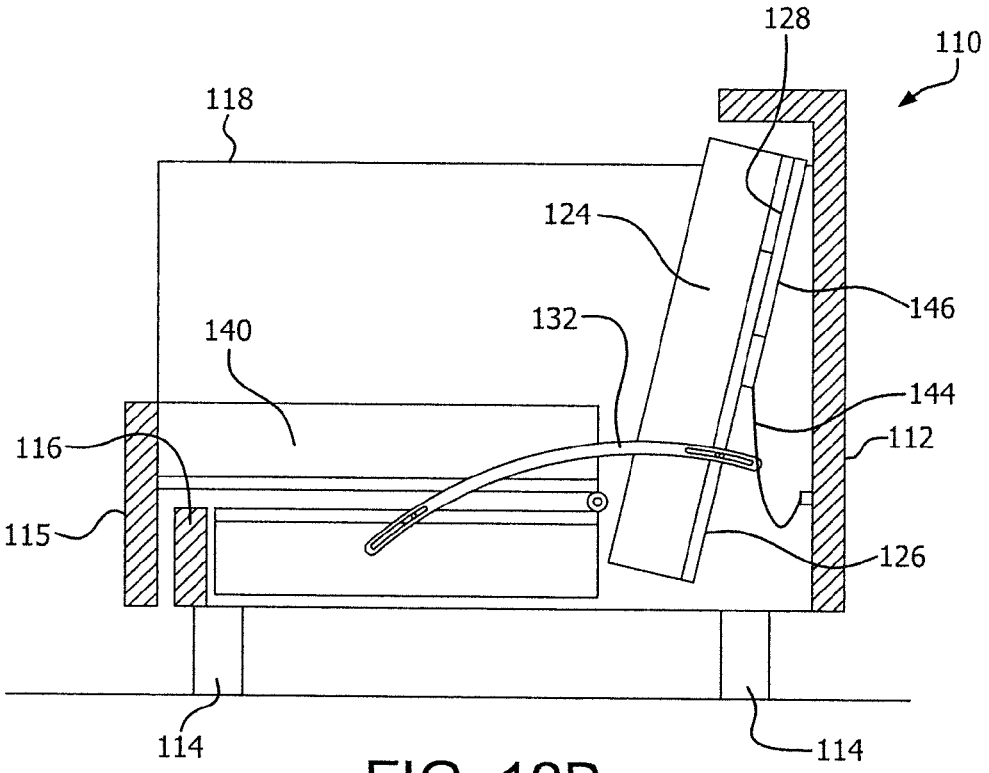
FIG. 12B is a right facing side elevational view in partial cross section showing the article of furniture of FIG. 12A with bolster cushion and seat cushion removed.
Figure 13:
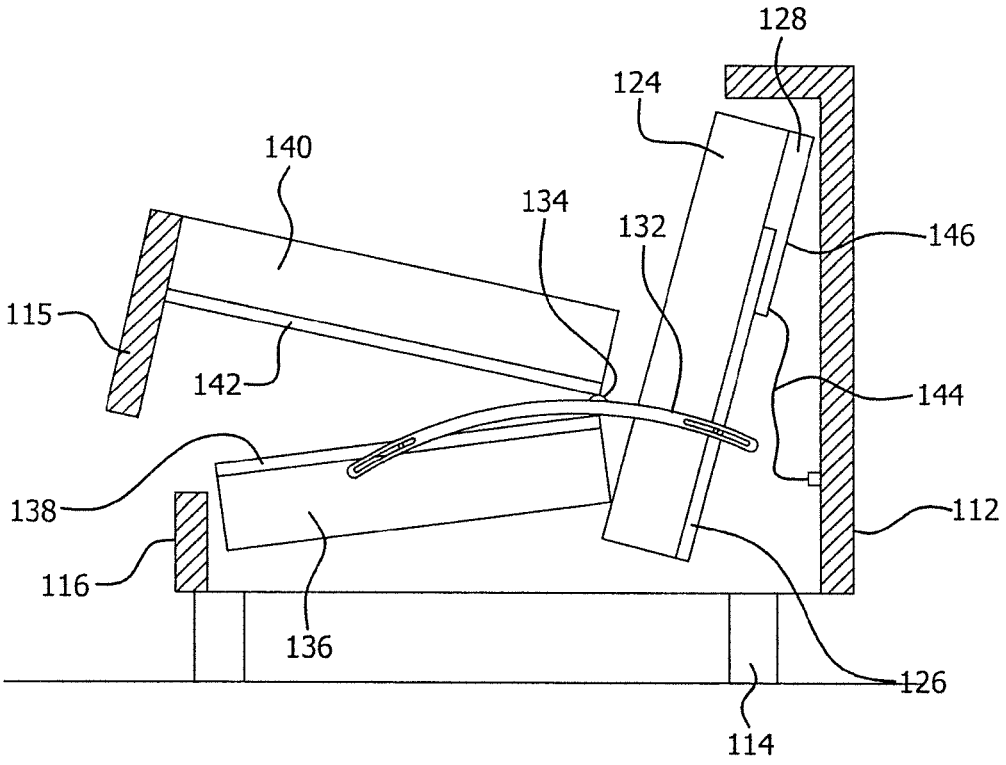
FIG. 13 is a right facing side elevational view in partial cross section of the article of furniture of FIG. 12B, shown in a first partially opened position.
Figure 14:
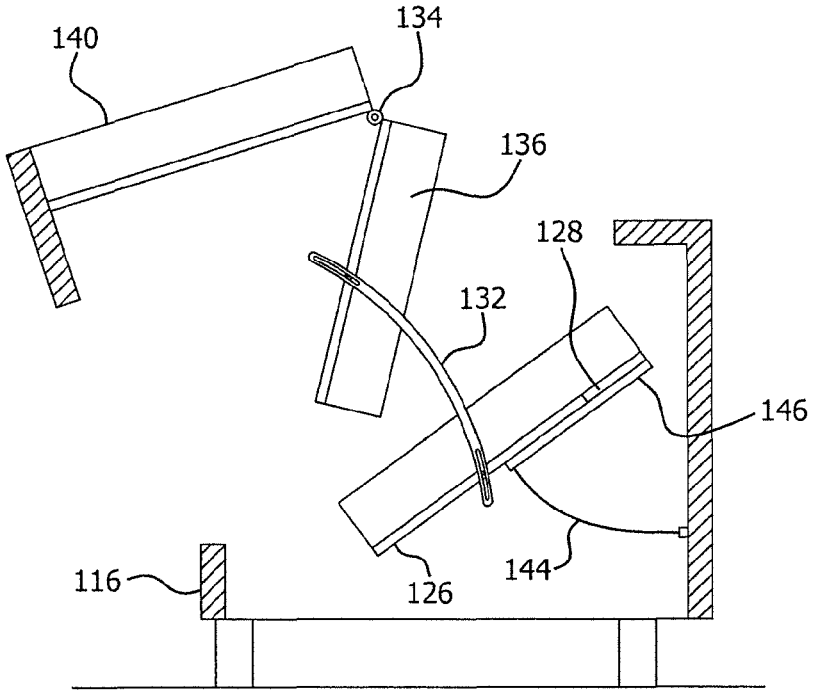
FIG. 14 is a right facing side elevational view in partial cross section of the article of furniture of FIG. 12B, shown in a second partially opened position.

In this embodiment, the first mattress section 124 is held in an upright position between the back frame 112 and the second and third mattress sections 136, 140 when the chair 110 is in the closed or seating configuration FIG. 12B). The first mattress section rotates and slides downwardly as shown in FIGS. 13, 14 and 15 as the convertible chair is converted from its closed or seating configuration to its open or sleeping configuration. The pulling action by the user when he or she pulls the third mattress section 140 and front leg 115 upward and outside of the volume space defined between the front frame 116 and back frame 112 of the chair is transferred via the cable or link 144 to the added support frame 146 to separate the first frame section 128 and second frame section 130, thereby applying a stretching force to and expanding the first mattress section 124 by opening the apertures (not shown) cut into the first mattress section 124.

The elongation of one or more mattress sections according to the invention offers a furniture designer greater flexibility with respect to furniture height and depth. In convertible furniture designs, one limiting factor can be the thickness of the seat cushion and any mattress elements stored within the internal volume when the furniture is in the closed or storage position. The internal volume of the furniture may have to be larger to accommodate the mattress elements. This can require convertible furniture to have very short legs or bases between the floor and the underside of the body. These aesthetics of convertible furniture often can be more bulky or heavier than other non-convertible furniture. By employing the invention using elongating mattress or cushion elements, design aesthetic may be improved. For example, the internal volume of the furniture may be reduced, resulting either in a higher leg height (i.e., increased distance from the floor to the underside of the furniture article body/frame) or lowering the overall back height of the furniture article. That is, by choosing different thicknesses for the removable seat cushion and for the mattress elements or even eliminating multiple cushion or mattress elements and replacing them with a single elongating cushion or mattress section in accordance with the invention, the distance from the floor to the underside of the body or frame of the article of furniture may be increased, without loss of cushioning support in the closed or seating configuration and without loss of adequate cushioning support in the open or sleeping configuration. The amount of elongation may be apportioned to lowering the overall height of the piece of furniture or lessening the overall depth of the piece of furniture or increasing the distance from the floor to the underside of the body or frame of the piece of furniture. The overall height of the article or piece of furniture in the closed or storage position may be reduced to a more acceptable height. All of these dimensions affect the visual quality, desirability, and marketability of the piece of furniture.

Various configurations for the mattress sections are possible. FIGS. 1 and 2 show slit polyurethane foam where the apertures are slits 12 are cut through the entire thickness of the foam slab—that is, from the top surface of the cushion all the way through to the bottom surface of the cushion. The slits 12 in this embodiment are formed in rows, with the slits of one row offset from the slits in an adjacent row. The slits are all of generally or substantially equivalent length.

Figure 16:
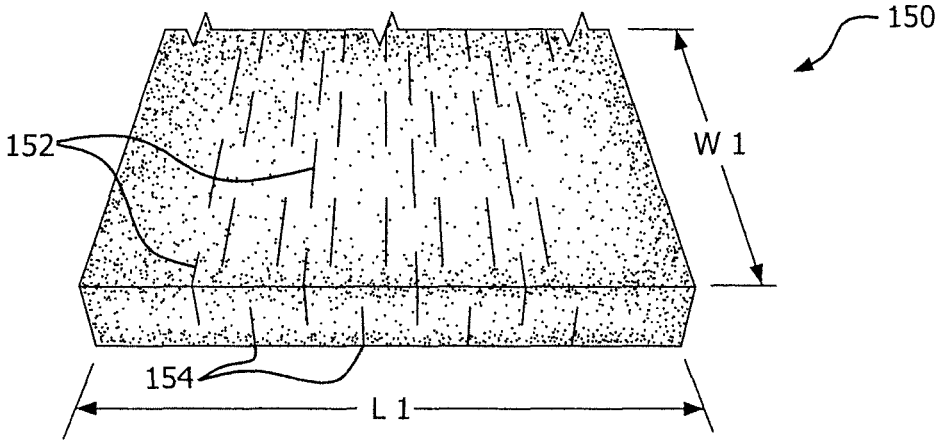
FIG. 16 is an end perspective view of an alternative embodiment of a cushion or mattress section.

Alternatively, a cushion or mattress section 150 such as shown in FIG. 16 may have apertures in the form of slits 152 that are cut into the top surface, but do not extend through the entire thickness of the foam slab. Such cushion or mattress section 150 also may have slits 154 that are cut into the bottom surface, but do not extend through the entire thickness of the foam slab. FIG. 16 shows the cushion or mattress section 150 in its first length L1 and width W1, before a stretching force is applied and the cushion or mattress section is expanded. Upon expansion, the slits 152 and 154 open to form crevices or recesses (not shown in FIG. 16).

Figure 17:
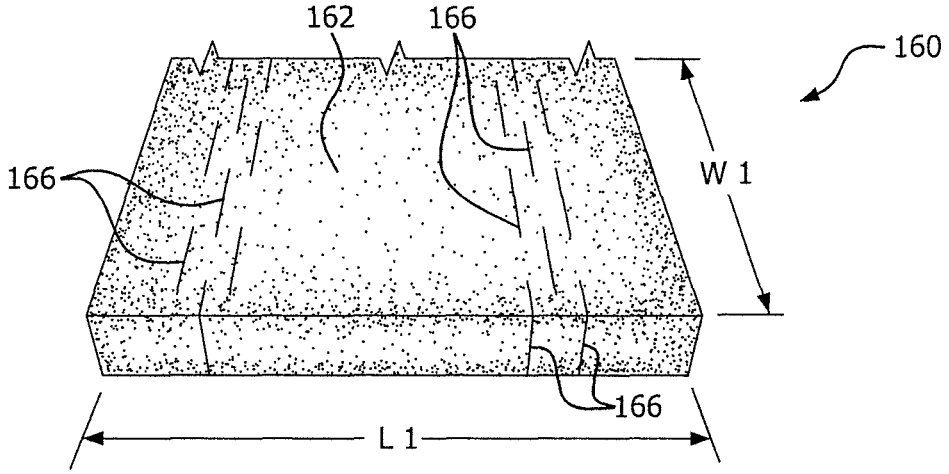
FIG. 17 is an end perspective view of yet another alternative embodiment of a cushion or mattress section.

As yet another alternative, as shown in FIG. 17, a cushion or mattress section 160 may have apertures in the form of slits 166 formed in certain regions of the foam slab, with other regions 162 not having slits formed therein or therethrough.

Figure 18:
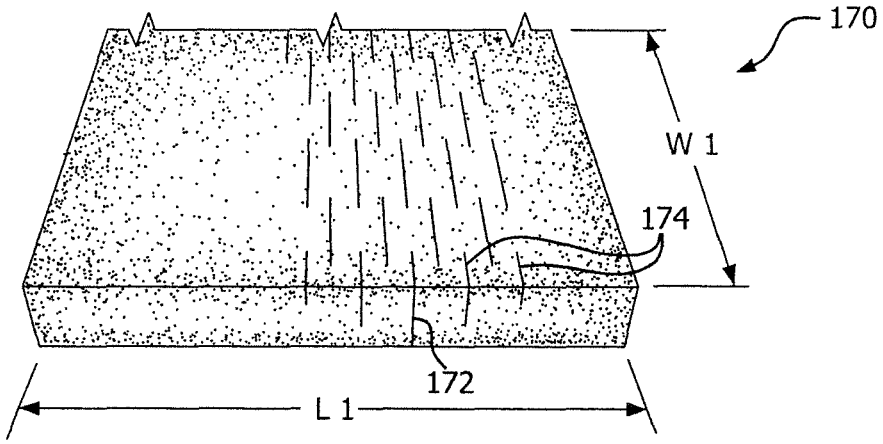
FIG. 18 is an end perspective view of still another alternative embodiment of a cushion or mattress section.

As still another alternative, as shown in FIG. 18, a cushion or mattress section 170 may have apertures in the form of slits 172 that are cut entirely through the thickness of the foam slab, and other slits 174 that are cut to different depths of the foam slab. Slits also could be cut in different lengths.

As used herein, an "aperture" may be a slit, a slot, a valley, a waffle cut or egg crate pattern or any other form of relief hole or recess or cavity cut, drilled or formed into the material of a cushion or mattress section that enables or enhances expansion of the material along a dimension when a stretching or pulling force is applied to said material. Apertures may or may not extend entirely through the thickness of the material. Ideally, the support surface of the cushion or mattress section remains substantially planar when the cushion or mattress section is in its unexpanded state, as well as when the cushion or mattress section is in its expanded state. If wide crevices or recesses or holes are to be formed in the cushion or mattress section when apertures are opened as the cushion or mattress section is expanded, preferably such are located at regions on the support surface where the cushion or mattress is not intended to support substantial body weight. Some designers may, however, prefer to locate apertures on the support surface of a cushion or mattress section to form wide crevices or recesses or holes at regions along the support surface of the expanded cushion or mattress section to modify the supporting characteristics, e.g., to cause portions of a reclining person's body to sink further into the cushion or mattress section than other body portions. See, e.g., U.S. Pat. Nos. 4,879,776 and 5,111,542 showing different recess patterns, with recesses of different depths and with recesses at different locations on the support surface of mattress toppers or cushions.

The invention has been illustrated by detailed description and examples of the preferred embodiments. Various changes in form and detail will be within the skill of persons skilled in the art. Therefore, the invention must be measured by the claims and not by the description of the examples or the preferred embodiments.

I claim:

1. A cushion comprising:

cushion material comprising at least one first surface and an initial cushion length, said cushion material defining at least one aperture extending through the at least one first surface to permit elongation of the cushion to a length longer than the initial cushion length when a stretching force is applied;

wherein the cushion is incorporated in a convertible furniture piece.

2. The cushion of claim 1, wherein the cushion material further comprises at least one second surface and the at least one aperture extends from the at least one first surface to the at least one second surface.

3. The cushion of claim 2, wherein the at least one second surface is generally parallel to and opposite to the at least one first surface.

4. The cushion of claim 1, wherein the at least one aperture has a configuration selected from the group consisting of: a slit, a slot, a hole, a cavity, a furrow, a valley, an egg-crate profile and a waffle-cut profile.

5. The cushion of claim 1, further comprising a plurality of apertures extending through the at least one first surface of the cushion material.

6. The cushion of claim 1, further comprising:

a protective layer covering at least a portion of the cushion material, the protective layer comprising a stretchable fabric that covers at least one surface of the cushion.

7. A convertible furniture article, comprising:

a first frame having at least a first frame section and at least a second frame section wherein at least one of the first frame section and second frame section is translatable from a first position to a second position; and at least one cushion section comprising at least one surface and having a first length when at least one of the first frame section and second frame section is in the first position;

said cushion section defining at least one aperture extending through the at least one surface of the cushion section to permit elongation of the cushion section when a stretching force is applied;

wherein said cushion section is joined to the first frame section and to the second frame section so that translating movement of at least one of the first frame section and second frame section applies a stretching force to the cushion section and expands the cushion section from the first length to a second length which is longer than the first, resting length.

8. The article of claim 7, wherein the at least one aperture has a configuration selected from the group consisting of: a slit, a slot, a hole, a cavity, a furrow, a valley, an egg-crate profile and a waffle-cut profile.

9. The article of claim 8, wherein the at least one aperture is oriented in a direction orthogonal to a direction of expansion of the at least one cushion section.

10. The article of claim 8, further comprising a plurality of apertures extending through the at least one surface of the cushion section.

11. The article of claim 10, wherein a portion of the plurality of apertures extend through a top surface of the cushion section and a portion of the plurality of apertures extend through a bottom surface of the cushion section.

12. The article of claim 10, wherein the at least one surface of the cushion section is a top surface and a portion of the plurality of apertures is formed in a portion of the top surface.

13. The article of claim 10, wherein the at least one surface of the cushion section is a bottom surface and a portion of the plurality of apertures is formed in a portion of the bottom surface.

14. The article of claim 8, wherein the at least one aperture extends through the thickness of the cushion section from a top surface to a bottom surface.

15. The article of claim 7, wherein the at least one surface of the cushion section has a generally planar configuration when said cushion section is at its first length and the at least one surface has a generally planar configuration when said cushion section is expanded to its second length.

16. The article of claim 7, further comprising:

a support member to which the first frame section and second frame section are slidably engaged.

17. The article of claim 16, wherein the support member is a telescoping support.

18. The article of claim 16, wherein the first frame section defines at least one channel or receiving hole to receive the support member and the second frame section defines at least one other channel or other receiving hole to receive the support member, and the first frame section and second frame section translate by sliding movement along the support member.

19. The article of claim 6, further comprising:

a second frame having at least a third frame section and at least a fourth frame section wherein at least one of the third frame section and fourth frame section is translatable from a third position to a fourth position; and at least one second cushion section comprising at least one second surface and having a third length when at least one of the third frame section and fourth frame section is in the third position;

said second cushion section defining at least one second aperture extending through the at least one second surface of the second cushion section to permit elongation of the second cushion section when a stretching force is applied;

wherein said second cushion section is joined to the third frame section and to the fourth frame section so that translating movement of at least one of the third frame section and fourth frame section applies a stretching force to the second cushion section and expands the second cushion section from the third length to a fourth length.

20. The article of claim 6, further comprising:

a protective layer covering at least a portion of the at least one cushion section.

21. The article of claim 20, wherein the at least one cushion section defines a top surface and the protective layer comprises a stretchable fabric that covers the top surface of the at least one cushion section.

22. The article of claim 20, wherein the at least one cushion section defines a bottom surface and the protective layer comprises a stretchable fabric that covers the bottom surface of the at least one cushion section.

23. The article of claim 7, comprising, in its first position, an article of furniture selected from the group consisting of: sofa, chair, ottoman, stool, loveseat, daybed, Murphy bed, footrest, bench, and table.

24. The article of claim 7, further comprising at least one additional cushion selected from the group consisting, of: bolster cushion, seat cushion, back cushion, and side panel.

25. The article of claim 7, wherein the at least one cushion section is formed of a material selected from the group consisting of: polyurethane foam, viscoelastic foam, and latex foam.

* * * * *